US011246790B2

(12) United States Patent
Lee

(10) Patent No.: US 11,246,790 B2
(45) Date of Patent: Feb. 15, 2022

(54) SYSTEMS AND METHODS FOR PROVIDING DUAL PURPOSE ARMRESTS AND CRUTCHES OF A WHEELCHAIR

(71) Applicant: Toyota Motor North America, Inc., Plano, TX (US)

(72) Inventor: Christopher Lee, Little Elm, TX (US)

(73) Assignee: Toyota Motor North America, Inc, Plano, TX (US)

( * ) Notice: Subject to any disclaimer, the term of this patent is extended or adjusted under 35 U.S.C. 154(b) by 349 days.

(21) Appl. No.: 16/541,423

(22) Filed: Aug. 15, 2019

(65) Prior Publication Data

US 2021/0045958 A1 Feb. 18, 2021

(51) Int. Cl.

| | |
|---|---|
| ***A61H 3/02*** | (2006.01) |
| ***A61G 5/12*** | (2006.01) |
| ***A61G 5/14*** | (2006.01) |
| *A61G 5/04* | (2013.01) |

(52) U.S. Cl.

CPC ..... *A61H 3/02* (2013.01); *A61G 5/125* (2016.11); *A61G 5/14* (2013.01); *A61G 5/04* (2013.01); *A61H 2201/0161* (2013.01)

(58) Field of Classification Search

CPC .. A61H 3/02; A61H 2201/0161; A61G 5/125; A61G 5/14; A61G 5/04

USPC ..... 280/657

See application file for complete search history.

(56) References Cited

U.S. PATENT DOCUMENTS

| | | | | |
|---|---|---|---|---|
| 2,129,260 A * | 9/1938 | Bowser | A61G 5/14 297/6 |
| 3,759,544 A * | 9/1973 | Korpela | A61G 5/1089 280/304.1 |
| 5,419,571 A * | 5/1995 | Vaughan | A61G 5/10 280/250.1 |
| 6,793,232 B1 * | 9/2004 | Wing | A61G 5/006 280/304.1 |

(Continued)

FOREIGN PATENT DOCUMENTS

| | | |
|---|---|---|
| CN | 202950852 | 5/2013 |
| CN | 204106370 | 1/2015 |
| GB | 2178375 | 2/1987 |

OTHER PUBLICATIONS

Wheelchair button locks, https://www.ocelco.com/store/pc/Wheelchair-Button-Locks-c243.htm, May 24, 2019.

*Primary Examiner* — James A Shriver, II
*Assistant Examiner* — Hilary L Johns
(74) *Attorney, Agent, or Firm* — Dinsmore & Shohl LLP

(57) ABSTRACT

Embodiments herein are directed to systems and methods of a wheelchair that includes a frame and a pair of armrests. The pair of armrests includes an arm pad, a sleeve configured to store a plurality of telescoping segments, and a pivot portion positioned between the arm pad and the sleeve. The plurality of telescoping segments is configured to extend in a system vertical direction. The pair of armrests is releasably coupled to the frame at the sleeve via a release mechanism. The pair of armrests is pivotable between a first position and a second position wherein when in the first position the pair of armrests is in an armrest position and in the second position the pair of armrests is pivoted in the system vertical direction such that the pair of armrests is a pair of crutches independently operable from the wheelchair.

20 Claims, 7 Drawing Sheets

(56) References Cited

U.S. PATENT DOCUMENTS

| | | | | |
|---|---|---|---|---|
| 9,421,138 | B1 * | 8/2016 | Slater | A61G 5/1002 |
| 10,258,533 | B1 * | 4/2019 | Chu | A61H 3/02 |
| 10,399,588 | B1 * | 9/2019 | Grantham, IV | B62B 5/067 |
| 2005/0236812 | A1 * | 10/2005 | Firth | A61G 5/1054 280/638 |
| 2011/0006494 | A1 * | 1/2011 | Walker | A61G 5/0825 280/7.17 |
| 2015/0290056 | A1 * | 10/2015 | Derringer | A61G 5/101 280/755 |
| 2015/0297438 | A1 * | 10/2015 | Hsu | A61H 3/02 135/69 |
| 2016/0022517 | A1 * | 1/2016 | Frangos | A61G 5/1054 280/657 |

* cited by examiner

SYSTEMS AND METHODS FOR PROVIDING DUAL PURPOSE ARMRESTS AND CRUTCHES OF A WHEELCHAIR

TECHNICAL FIELD

The present disclosure generally relates to a wheelchair and, more specifically, to wheelchairs having armrests that transform into crutches.

BACKGROUND

Certain users of a powered wheelchair may also be users of independent crutches that help facilitate movement for the user. Typically, the user may use crutches for movement when the user is out of or not near the powered wheelchair. However, because the crutches are an additional piece of equipment, users have to either store the crutches on the wheelchair, have a second person bring the crutches to the user, or stage the crutches where the user intends to exit the powered wheelchair. Furthermore, because of the size of the crutches, they are not easily transported via the powered wheelchair and the transporting of the crutches limits the mobility of the powered wheelchair.

Accordingly, a need exists for an easily storable and transportable pair of crutches for the user.

SUMMARY

In one embodiment, a wheelchair includes a frame and an armrest. The armrest includes a first end spaced apart from a second end, a sleeve configured to store a plurality of telescoping segments, the plurality of telescoping segments configured to extend in a system vertical direction, and a pivot portion positioned between the first end and the second end. The armrest is releasably coupled to the frame at the sleeve via a release mechanism. The armrest is pivotable between a first position and a second position. When in the first position, the armrest is in an armrest position and in the second position, the armrest is pivoted in the system vertical direction such that the armrest is configured as a crutch independently operable from the wheelchair.

In another embodiment, a powered wheelchair includes a frame, a pair of armrests releasably coupled to the frame via a release mechanism and a master controller. The pair of armrests include a first end and a second end, a sleeve configured to store a plurality of telescoping segments, the plurality of telescoping segments configured to extend in a system vertical direction, and a pivot portion positioned between the first end and the second end. The pair of armrests is communicatively coupled to the master controller. The master controller coordinates pivoting the pair of armrests between a first position and a second position. When in the first position, the pair of armrests is in an armrest position and, in the second position, the pair of armrests is pivoted in the system vertical direction such that the pair of armrests is configured as a pair of crutches independently operable from the powered wheelchair.

In yet another embodiment, a method for controlling a pair of armrests of a powered wheelchair to use the pair of armrests as a crutch is provided. The method includes receiving, by a master controller, an input from a user, the input corresponding to a function, raising, by the master controller, a seat portion of the powered wheelchair in a system vertical direction, and pivoting, by the master controller, the pair of armrests from a first position to a second position. The method continues by extending, by the master controller, a plurality of telescoping segments in the system vertical direction, and decoupling, by the master controller, the pair of armrests from a frame of the powered wheelchair.

These and additional objects and advantages provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The systems and methods described herein generally relate to a powered wheelchair having a pair of armrests that transform into crutches, which are independently operable from the powered wheelchair. The systems described herein are configured such that the powered wheelchair and the pair of armrests are communicatively coupled to a master controller. When concurrent control of the powered wheelchair and the pair of armrests is warranted, the controller controls movement of the pair of armrests such that the pair of armrests are pivoted between a first position and a second position. In the second position, a plurality of telescoping sections extend from each armrest. As a result, each armrest may be disconnected from the powered wheelchair such that a user may use the pair of armrests as a pair of crutches to assist in movement when not in the powered wheelchair. Further, the master controller coordinates a plurality of synchronized movements between the powered wheelchair and the pair of armrests.

As described in further detail herein, an example of synchronized movements may include coordinating the pair of armrests with the powered wheelchair such that a seat portion of the powered wheelchair rises and the pair of armrests is rotated to the second position such that there is space for the plurality of telescoping sections to extend from each armrest. Further, the seat portion of the powered wheelchair is raised which assists in helping the user sit into or exit from a sitting position in the powered wheelchair while utilizing the crutches.

Figure 1:
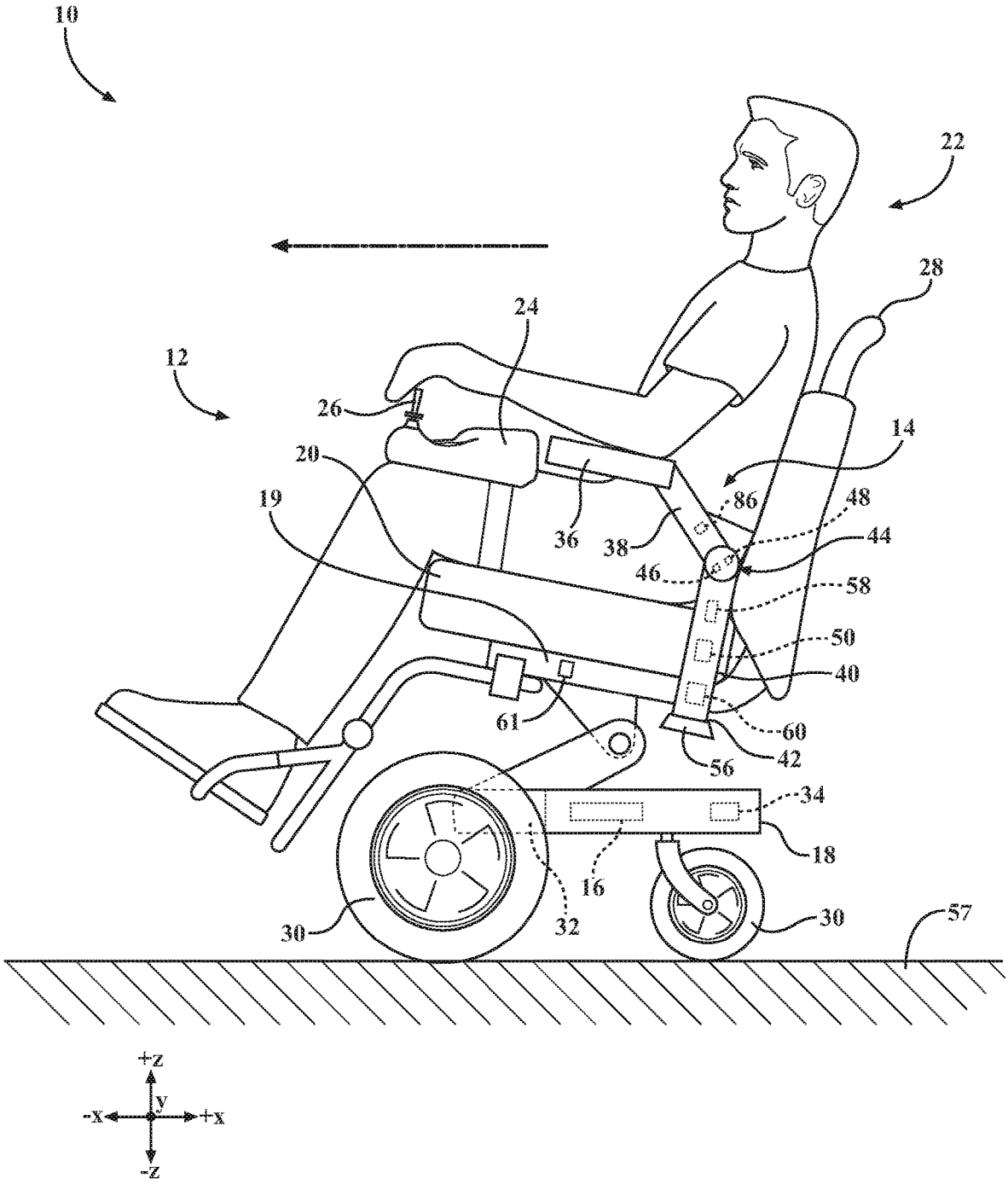
FIG. 1 schematically depicts an illustrative system having a powered wheelchair and a pair of armrests according to one or more embodiments shown or described herein.

As used herein, the term "system longitudinal direction" refers to the forward-rearward direction of the system (i.e., in a +/−X direction of the coordinate axes depicted in FIG. 1). The term "system lateral direction" refers to the cross-direction (i.e., along the Y axis of the coordinate axes depicted in FIG. 1), and is transverse to the longitudinal direction. The term "system vertical direction" refers to the upward-downward direction of the system (i.e., in the +/−Z direction of the coordinate axes depicted in FIG. 1). As used herein, "upper" or "uppermost" is defined as generally being towards the positive Z direction of the coordinate axes shown in the drawings. "Lower" or "lowermost" is defined as generally being towards the negative Z direction of the coordinate axes shown in the drawings.

Figure 2:
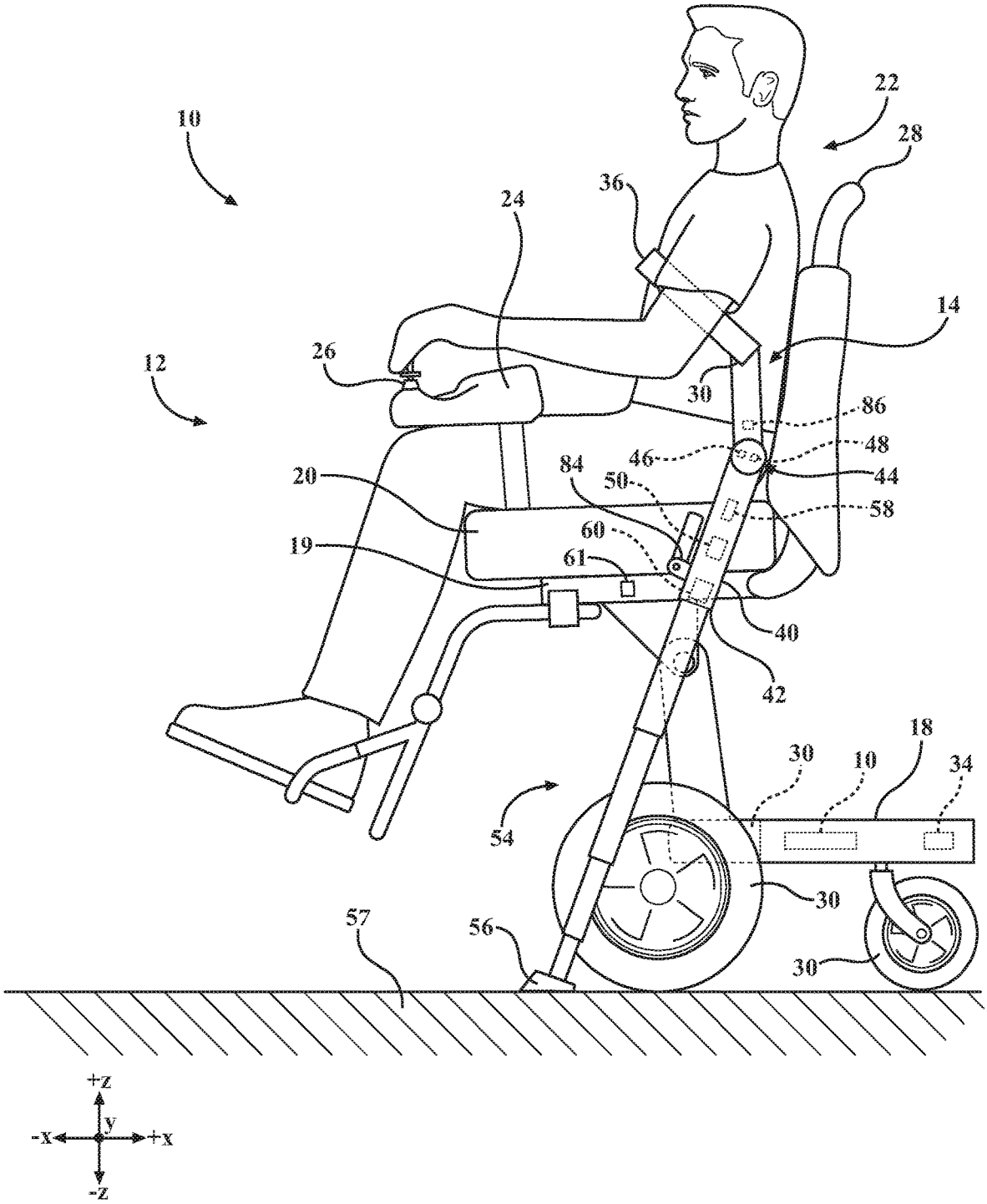
FIG. 2 schematically depicts the system of FIG. 1 when the powered wheelchair is in a raised position and the pair of armrests are pivoted to a second position according to one or more embodiments shown or described herein.
Figure 3:
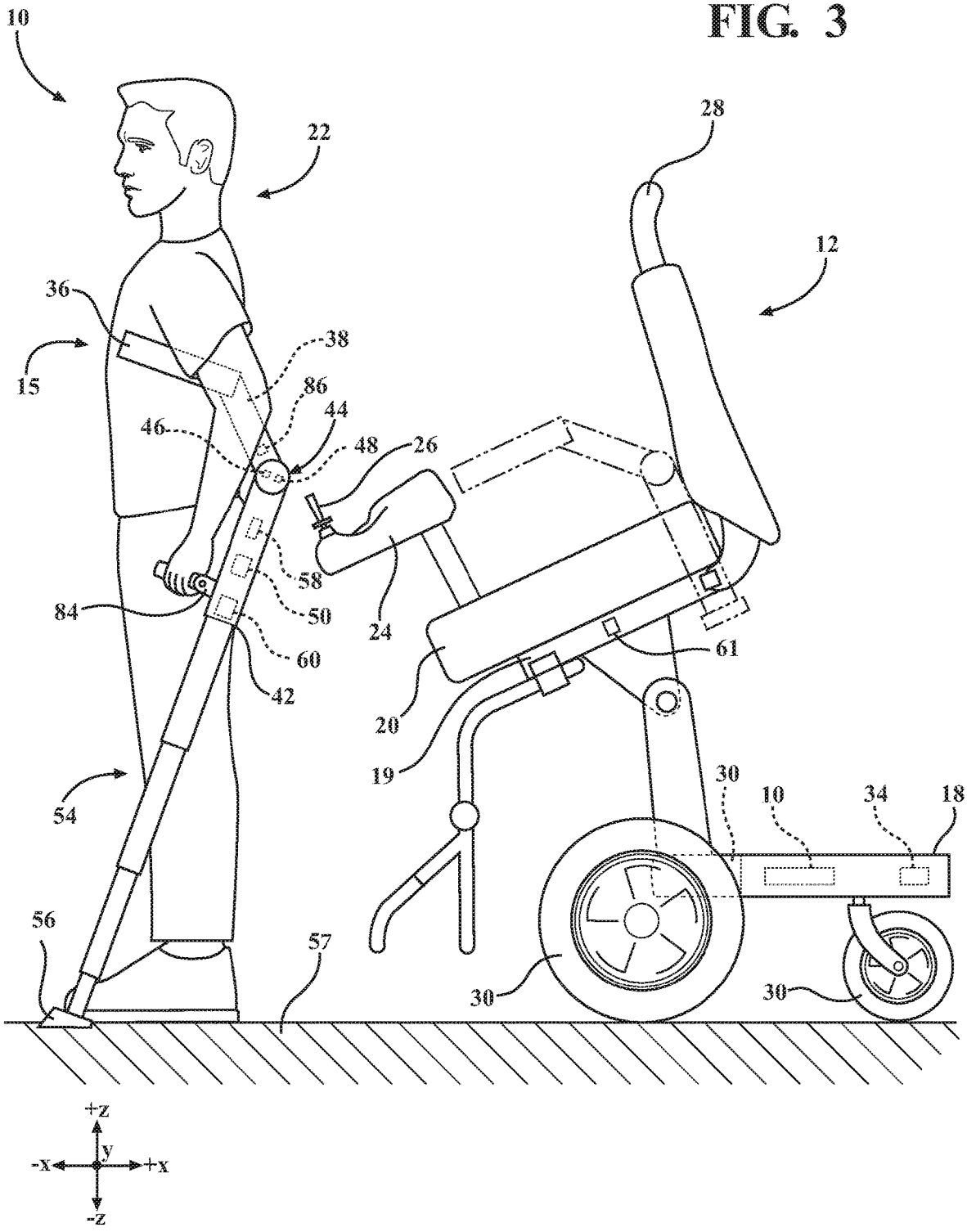
FIG. 3 schematically depicts the system of FIG. 1 when the pair of armrests are transformed into a pair of crutches according to one or more embodiments shown or described herein.

Referring initially to FIGS. 1-3, a schematic depiction of a system, generally designated 10, is provided. The system 10 generally includes a wheelchair 12 having a pair of armrests 14, and a master controller 16. The wheelchair 12 may be a powered wheelchair, but is not limited thereto. As described in greater detail herein, the system 10 may generally provide an ability to coordinate movements of the wheelchair 12 and the pair of armrests 14 via the master controller 16.

The wheelchair 12 is a generally recognized wheelchair and, in embodiments, may be a powered wheelchair that includes motorized components that allow a user 22 to electronically control movement of the wheelchair. Accordingly, various components of the wheelchair 12 should be understood and are not described in further detail herein. In some embodiments, the wheelchair 12 may include a power base portion 18, a frame 19, and a seat portion 20 supported by the frame 19, which in turn is supported by the power base portion 18. Thus, the frame 19 is generally positioned below the seat portion 20 in a system vertical direction (i.e., positioned in the −Z direction of the coordinate axes of FIG. 1 relative to the seat portion 20) and the power base portion 18 is generally positioned below the frame 19 in a system vertical direction (i.e., positioned in the −Z direction of the coordinate axes of FIG. 1 relative to the frame 19). Still referring to FIGS. 1-3, in some embodiments, the power base portion 18 may raise, tilt, or otherwise move the frame 19 and subsequently the seat portion 20. The frame 19 and the seat portion 20 are generally configured to support a user 22 when the user 22 is seated in the wheelchair 12.

Still referring to FIGS. 1-3, in some embodiments, the seat portion 20 may include at least one hand rest 24 to which a controller 26 may be coupled. The at least one hand rest 24 may be positioned forward of the pair of armrests 14 in the system longitudinal direction (i.e., in the +/−X direction). However, it should be understood that in some embodiments, the wheelchair 12 may not have the at least one hand rest 24 and the controller 26 may be coupled to another portion of the wheelchair 12. As described herein the controller 26 may provide the user 22 with an ability to control movement of the wheelchair 12. In some embodiments, the controller 26 may be a joystick-type controller where the user 22 directs the joystick in accordance with a desired direction and/or speed of travel. Accordingly, the controller 26 may be communicatively coupled to the power base portion 18, including various components thereof, to transmit signals to the power base portion 18 to cause the wheelchair 12 to respond according to the inputs received by the controller 26. It should be understood that the joystick configuration is merely illustrative, and in some embodiments, the controller 26 may utilize other designs, such as buttons, switches, voice controls, breath controls, and/or the like to receive inputs from a user 22 via a user interface and the like.

In some embodiments, the seat portion 20 may include one or more handles 28 integrated therein or coupled thereto. The one or more handles 28 may provide an area for the user 22 to grip the wheelchair 12. For example, at least one of the one or more handles 28 may be located on a back portion of the seat portion 20 such that the user 22 may grasp the at least one handle 28 when moving behind the wheelchair 12.

The power base portion 18 may include, but is not limited to, a plurality of wheels 30, a motor 32, a battery 34, and the master controller 16. The master controller 16 may be an electronic control unit and may generally be a control device that controls the wheelchair 12 and/or one or more components thereof. As such, the master controller 16 may be communicatively coupled to the various components of the wheelchair 12 such that one or more control signals can be transmitted from the master controller 16 to the various components such as the pair of armrests 14, as described in greater detail herein. The motor 32 may be coupled to the wheels 30 to drive movement of the wheels 30. The battery 34 may generally provide electrical power to the various components of the wheelchair 12. Other components of the power base portion 18 should generally be understood and are not described in further detail herein.

Still referring to FIGS. 1-3, in various embodiments, the wheelchair 12 may include the pair of armrests 14. In the illustrated embodiments, each armrest 14 includes an arm pad 36 at a first end 38, a sleeve 40 at an opposite second end 42, and a pivot mechanism 44 positioned between the first end 38 and the second end 42. The pivot mechanism 44 is generally positioned above the seat portion 20 of the wheelchair 12 in the system vertical direction (i.e., in the +/−Z direction). In some embodiments, the pivot mechanism 44 includes a clutch 46 and a plurality of gears 48 commutatively coupled to at least one actuator 50 and to the master controller 16. In other embodiments, the pivot mechanism 44 is pivoted manually by the user 22 using a lever 86, as discussed in greater detail herein. In yet other embodiments, a plurality of predetermined bores are arranged around the pivot mechanism 44 and a pin or an elongated member is used to lock the pivot mechanism into a desired position.

In some embodiments, the at least one actuator 50 is positioned within each armrest 14. In other embodiments, the at least one actuator 50 is positioned somewhere other than within the pair of armrests 14. The at least one actuator 50 and the clutch 46 are configured to work in conjunction such that the each armrest 14 may be pivoted from a first position, as best seen in FIG. 1, to a second position, as best seen in FIG. 2. That is, in the first position, the pair of armrests 14 extend along a plane in the system longitudinal direction (i.e. in the +/−X direction) and are at an appropriate height for the user 22 to rest an elbow, forearm, and the like on the arm pad 36 of the pair of armrests 14, as depicted best in FIG. 1. As such, the first position is an armrest position.

In the second position, the arm pad 36 of the pair of armrests 14 is rotated at an angle with respect to the arm of the user 22 such that the arm pad 36 is rotated in the system vertical direction (i.e., in the +/−Z direction) into an arm pit area of the user 22, as best seen in FIG. 2. The arm pad 36 is rotated such that the user 22 may use the arm pad 36 as padding when the user 22 stands from the wheelchair 12 and the pair of armrests 14 are transformed into the pair of crutches 15 (FIG. 3), as discussed in greater detail herein. As such, the second position is a crutch position. In some embodiments, the angle that the arm pad 36 of the pair of armrests 14 is rotated with respect to the arm of the user 22 is an obtuse angle. In other embodiments, the angle that the arm pad 36 of the pair of armrests 14 is rotated with respect to the arm of the user 22 is an acute angle. It should be appreciated that the angles are adjustable as is the height that the arm pad 36 moves so to be customizable for each user 22.

Still referring to FIGS. 1-3, the at least one actuator 50, the clutch 46 and/or the plurality of gears 48 may be controlled by the master controller 16 such that the master controller 16 releases the clutch 46 and the at least one actuator 50 drives the plurality of gears 48 to pivot each armrest 14 between the first positon and the second position about the sleeve 40, which may still be releasably coupled to the frame 19 of the wheelchair 12. Accordingly, the master controller 16 may be communicatively coupled to each armrest 14 to transmit signals to the pivot mechanism 44 including the at least one actuator 50, the clutch 46 and/or the plurality of gears 48 to cause each armrest 14 to pivot from the first position to the second position and vice versa according to the inputs received by the master controller 16. In some embodiments, the controller 26 may be used to receive inputs from the user 22. In other embodiments, a button, switch, voice control, breath control, and/or the like may be utilized to receive inputs from the user 22. Further, in some embodiments, the button, switch, voice control, breath control, and/or the like may be positioned on one or both of the pair of armrests 14, on the at least one hand rest 24, and/or other positions on the wheelchair 12, or remotely controlled.

It should be appreciated that in some embodiments, the clutch 46 is mechanically driven rather than electro-mechanically. That is, in some embodiments, the user 22 may release the clutch 46 via the lever 86 and rotate or pivot the pair of armrests 14 from the first position to the second positon. Further, the releasing of the sleeve 40 from the frame 19 of the wheelchair 12 may be manually performed by the user 22 or someone else, as discussed in detail below. It should be appreciated that, in some embodiments, the lever 86 may be attached to the first end 38 of the pair of armrests 14. In other embodiments, the lever 86 may be attached to the sleeve 40, to the arm pad 36, and/or anywhere else on the wheelchair 12 as appreciated by one skilled in the art.

With reference now to FIGS. 1-4, each sleeve 40 of the pair of armrests 14 is releasably coupled to the frame 19 of the wheelchair 12 via a release mechanism 52. In some embodiments, the release mechanism 52 is a component that mechanically couples the sleeve 40 of the pair of armrests 14 to the frame 19 of the wheelchair 12. For example, the component may be a bore extending through the frame 19 and at least a portion of the sleeve 40. The bore is configured to receive an elongated member to releasably couple the sleeve 40 to the frame 19 via the elongated member. In some embodiments, the elongated member is a pin having a protrusion extended from a surface thereon that may be spring loaded to releasably lock the pin within the bore (e.g. a locking pin). In other embodiments, the elongated member may be the pin with an aperture extending there through and configured to a c-clip, a cotter pin, and the like to releasably lock the pin within the aperture.

In other embodiments, the release mechanism 52 is a magnetic component and configured to releasably couple the sleeve 40 of each armrest 14 to the frame 19 of the wheelchair 12. It should be appreciated that the strength of the magnet is such that the pair of armrests 14 remain coupled during travel of the wheelchair 12, but may be released upon a request by the user 22. In some embodiments, the user 22 may release the pair of armrests 14 from the frame 19 by applying a force to the pair of armrests 14 in a direction opposite of the magnetic forces caused by the magnet. In other embodiments, the user 22 may release the pair of armrests 14 from the frame 19 by applying a force to the pair of armrests 14 in a direction transverse to the magnetic forces caused by the magnet. In some embodiments, the magnet of the release mechanism 52 is a plurality of magnets. As appreciated by those skilled in the art, the magnet described herein may be a permanent magnet, a temporary magnet, or the electro-magnet.

Still referring to FIGS. 1-4, in yet other embodiments, the release mechanism 52 is electro-magnetic component and configured to releasably couple the sleeve 40 of each armrest 14 to the frame 19 of the wheelchair 12. It should be appreciated that the strength of the magnet is such that the pair of armrests 14 remain coupled during travel of the wheelchair 12, but may be released upon a request by the user 22. In some embodiments, the master controller 16 may be communicatively coupled to release mechanism 52 of each armrest 14 to transmit signals to the release mechanism 52 to cause each armrest 14 to release from the frame 19 of the wheelchair 12 and vice versa according to the inputs received by the master controller 16. In some embodiments, the controller 26 may be used to receive inputs from the user 22. In other embodiments, a button, switch, voice control, breath control, and/or the like may be utilized to receive inputs from the user 22.

It should be appreciated that in some embodiments, when the pair of armrests 14 are coupled to the wheelchair 12 via the release mechanism 52, the pivot mechanism 44 is communicatively coupled to the master controller 16, the battery 34, and other various components of the wheelchair 12.

Still referring to FIGS. 1-4, the sleeve 40 further houses a plurality of telescoping segments 54. Each segment of the plurality of telescoping segments 54 have a different inner diameter such that each segment is nested into an adjacent segment when in the retracted state such each segment of the plurality of telescoping segments 54 fits within the sleeve 40. Further, in embodiments, the lowermost segment of the plurality of telescoping segments 54 may include a stopper portion 56 configured to engage with a floor surface 57 when using the pair of armrests 14 as a pair of crutches 15. The stopper portion 56 may be a rubber material, a ceramic material, a metal material, and the like such that the stopper portion 56 provides an anti-slip or creates friction between the plurality of telescoping segments 54 and the floor surface 57. It should be appreciated that the length of the plurality of telescoping segments 54 is customizable for each user 22 to predetermined heights in the system vertical direction (i.e., in the +/−Z direction).

In some embodiments, the plurality of telescoping segments 54 may be extended mechanically by the user 22. In these embodiments, the plurality of telescoping segments 54 may be held in the sleeve 40 by a screw lock. That is, the sleeve 40 may include a treaded portion and the uppermost segment of the plurality of telescoping segments 54 includes a fitting that may be rotated or screwed in one direction onto the traded portion to lock the plurality of telescoping segments 54 into the sleeve 40 or rotated in an opposite direction to release the plurality of telescoping segments 54 from the sleeve 40.

In other embodiments, the at least one actuator 50 is coupled to the plurality of telescoping segments 54 to extend or retract the plurality of telescoping segments 54 in the system vertical direction (i.e., in the +/−Z direction). The at least one actuator 50 may be powered by the battery 34 of the wheelchair 12.

In some embodiments, the sleeve 40 may include a handle 84 that rotates between a stowed position and a use position. In the use position, the handle 84 extends outwardly from an exterior surface of the sleeve 40 in a direction transverse to the plurality of telescoping segments 54. In the stowed position, the handle 84 may extend upwardly in the system vertical direction (i.e., in the +/−Z direction) along the exterior surface of the sleeve 40 in a direction parallel to the plurality of telescoping segments 54. It should be appreciated that the handle 84 may provide additional support to a hand of the user when the pair of armrests 14 are being used as the pair of crutches 15, as best seen in FIG. 3.

Still referring to FIGS. 1-4, in some embodiments, the pair of armrests 14 further include a battery 58 coupled to the at least one actuator 50 and a control unit 60 such that the plurality of telescoping segments 54 may be extended and/or retracted in the system vertical direction (i.e., in the +/−Z direction) independent from the wheelchair 12. That is, the plurality of telescoping segments 54 may be extended and/or retracted without the need to be connected to wheelchair 12. As such, the control unit 60 may be communicatively coupled to the battery 58 and the at least one actuator 50 to transmit signals to the at least one actuator 50 to cause the plurality of telescoping segments 54 to extend and/or retract in the system vertical direction (i.e., in the +/−Z direction) according to the inputs received by the control unit 60. In some embodiments, a button may be used to receive inputs from the user 22. In other embodiments, a toggle switch, a switch, and/or the like may be utilized to receive inputs from the user 22. Further, in some embodiments, the button, switch, and/or the like may be positioned on one of the pair of armrests 14 and communicated to the other one of the pair of armrests 14, or on both of the pair of armrests 14, and/or remotely controlled. In some embodiments, when the pair of arm rests are connected to the frame 19 of the wheelchair 12, the battery 34 of the wheelchair 12 charges the battery 58 of the pair of armrests 14. Similarly, the battery 34 of the wheelchair 12 may provide power to the control unit 60 of the pair of armrests 14 when connected to the wheelchair 12.

Still referring to FIGS. 1-4, in various embodiments, the wheelchair 12 may include a plurality of sensors (e.g. a seat position sensor 61) that may transmit a plurality of outputs, either wired or wirelessly, to the master controller 16, as explained in greater detail herein. The seat position sensor 61 may be a laser-based sensor, a proximity sensor, a level detection sensor, a pressure sensor, any combination thereof, and/or any other type of sensor that can detect a position of the seat portion 20. In various embodiments, the seat position sensor 61 may communicate the position of the seat portion 20, such as the tilt of the seat portion 20 with respect to the power base portion 18, whether the tilt is forward or rearward, and/or the height of the seat portion 20 (e.g., whether the seat portion 20 is lowered in a sitting position or raised into a standing position).

The master controller 16 may generally be a standalone control device that contains one or more components for controlling movement of the wheelchair 12 and/or the pair of armrests 14. It should be appreciated that while the master controller 16 is shown in FIGS. 1-3 as part of the wheelchair 12, this is a non-limiting example. That is, the master controller 16 may be a device that is separate from the wheelchair 12, such as a device that is coupled to or integrated with the pair of armrests 14. In some embodiments, the master controller 16 may be separate from both the wheelchair 12 and the par of armrests 14, such as, for example, a user carried computing device, the user's mobile device, or the like.

Figure 5:
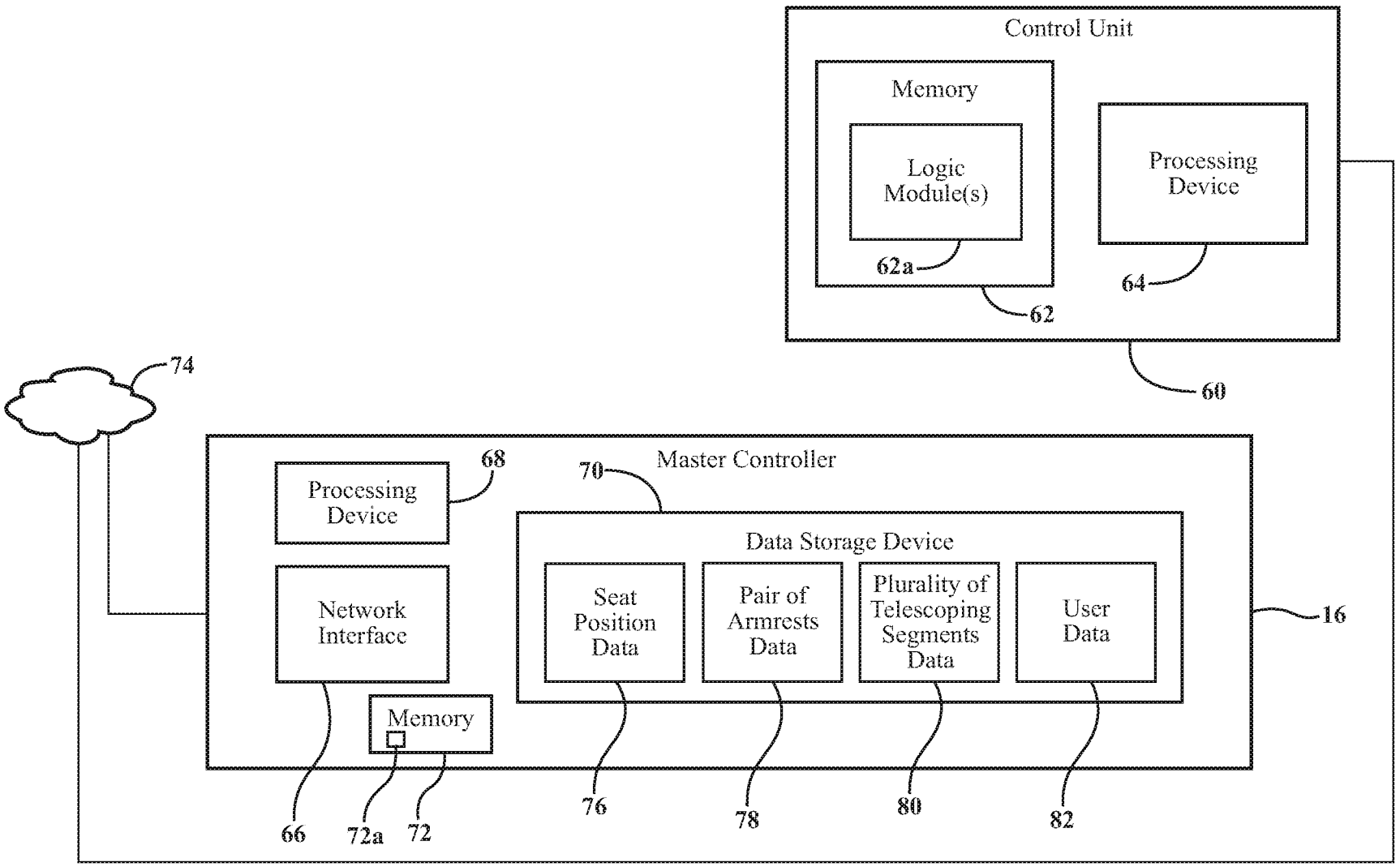
FIG. 5 schematically depicts a block diagram of illustrative components of a master controller and of a control unit communicatively coupled together of the system of FIG. 1 according to one or more embodiments shown or described herein.

Now referring to FIG. 5 in which various illustrative internal components of the master controller 16 and internal components of the control unit 60 communicatively coupled together are schematically depicted. More specifically, the master controller 16 may be communicatively coupled to the control unit 60 when the control unit 60 is connected to the wheelchair 12 (FIG. 1) (e.g. when the pair of armrests 14 is coupled to the wheelchair 12). In some embodiments, the master controller 16 may be communicatively coupled to the control unit 60 via a network 74. The network 74 may include a wide area network (WAN), such as the Internet, a local area network (LAN), a mobile communications network, a public service telephone network (PSTN), a personal area network (PAN), a metropolitan area network (MAN), a virtual private network (VPN), and/or another network that can electronically connect the master controller 16 and the control unit 60 together.

In various embodiments, the control unit 60 may include, but is not limited to, a memory component 62 and a processing device 64. The processing device 64, such as a computer processing unit (CPU), may be the central processing unit of the control unit 60, performing calculations and logic operations to execute a program. The processing device 64, alone or in conjunction with the other components, is an illustrative processing device, computing device, processor, or combination thereof. The processing device 64 may include any processing component configured to receive and execute instructions (such as from the memory component 62).

In some embodiments, the memory component 62 may be configured as a volatile and/or a nonvolatile computer-readable medium and, as such, may include random access memory (including SRAM, DRAM, and/or other types of random access memory), read only memory (ROM), flash memory, registers, compact discs (CD), digital versatile discs (DVD), and/or other types of storage components. Further, the memory component 62 may be a non-transitory, processor-readable memory. The memory component 62 may include one or more programming instructions thereon that, when executed by the processing device 64, cause the processing device 64 to complete various processes, such as one or more of the processes described herein with respect to FIGS. 6-7.

Still referring to FIG. 5, the programming instructions stored on the memory component 62 may be embodied as one or more software logic modules **62*a*, where each logic module 62*a* provides programming instructions for completing one or more tasks, as described in greater detail below with respect to FIGS. 6-7. Still referring to FIG. 5, the logic module 62*a* includes a plurality of different pieces of logic, each of which may be embodied as a computer program, firmware, and/or software/hardware, which may be executable by the processing device 64**.

In various embodiments, the master controller 16 includes a network interface 66, a processing device 68, a data storage device 70, and a memory component 72. The processing device 68, such as a computer processing unit (CPU), may be the central processing unit of the master controller 16, performing calculations and logic operations to execute a program. The processing device 68, alone or in conjunction with the other components, is an illustrative processing device, computing device, processor, or combination thereof. The processing device 68 may include any processing component configured to receive and execute instructions (such as from the memory component 72).

In some embodiments, the memory component 72 may be configured as a volatile and/or a nonvolatile computer-readable medium and, as such, may include random access memory (including SRAM, DRAM, and/or other types of random access memory), read only memory (ROM), flash memory, registers, compact discs (CD), digital versatile discs (DVD), and/or other types of storage components. Further, the memory component 72 may be a non-transitory, processor-readable memory. The memory component 72 may include one or more programming instructions thereon that, when executed by the processing device 68, cause the processing device 68 to complete various processes, such as one or more of the processes described herein with respect to FIGS. 6-7.

Still referring to FIG. 5, the programming instructions stored on the memory component 72 may be embodied as one or more software logic modules 72*a*, where each logic module 72*a* provides programming instructions for completing one or more tasks, as described in greater detail below with respect to FIGS. 6-7. Still referring to FIG. 5, the logic module 72*a* includes a plurality of different pieces of logic, each of which may be embodied as a computer program, firmware, and/or software/hardware, which may be executable by the processing device 68.

The network interface 66 of the master controller 16 may include any wired or wireless networking hardware, such as a modem, LAN port, wireless fidelity (Wi-Fi) card, WiMax card, mobile communications hardware, and/or other hardware for communicating with other networks and/or devices. Therefore, the communication between the master controller 16, the wheelchair 12, and/or the pair of armrests 14 may be provided through the network interface 66. In one example, the master controller 16 may wirelessly communicate with the pair of armrests 14 and the wheelchair 12.

It should be appreciated that the user controls, as discussed in greater detail herein, may be transmitted to the master controller 16 through the network interface 66. Further, it should be appreciated that the user 22 may select the user controls by a button, such as a push button, a switch, such as a toggle switch, and the like on the wheelchair 12 including from on the pair of armrests 14 or from a program selection initiated at an external device such as a portable computing device, smartphone, or the like.

The data storage device 70, which may generally be a storage medium, may contain one or more data repositories for storing data that is received and/or generated, and may be any physical storage medium, including, but not limited to, a hard disk drive (HDD), memory, removable storage, and/or the like. While the data storage device 70 is depicted as a local device, it should be understood that the data storage device 70 may be a remote storage device, such as, for example, a server computing device or the like. Illustrative data that may be contained within the data storage device 70 is described below with respect to FIGS. 6-7 and includes, but is not limited to seat position data 76 from the seat position sensor 61 (FIGS. 1-3), pair of armrests data 78, a telescoping segments data 80 and user data 82 generated by the user 22.

Still referring to FIG. 5, the master controller 16 may use data stored on the data storage device 70 to coordinate a movement, multiple movements, and/or extend or retract the plurality of telescoping segments 54 (FIGS. 1-3), as discussed in greater detail herein.

In some embodiments, under one operation, the wheelchair 12 and the pair of armrests 14 may move independently of one another within particular parameters. As such, the particular parameters may be predetermined logic programs that are stored in the logic module 62*a* and initiated during independent operation of the wheelchair 12. Under another operation, a program stored in the logic module 62*a* may be accessed and executed whereby the master controller 16 may coordinate the movements of the wheelchair 12 and the pair of armrests 14 to achieve a particular function, movement, and/or the like, such as raising the seat portion 20 of the wheelchair 12, pivoting the pair of armrests 14 from the first position to the second position, extending the plurality of telescoping segments 54 of the pair of armrests 14 and releasing the pair of armrests 14 from the release mechanism 52. In some embodiments, the operations may be completed on the fly (i.e., as the user actively attempts to complete various tasks) or may be completed as a preset program (i.e., to move the user through a preset set of steps as part of a rehab program, a training program, and/or the like).

In some embodiments, during coordinated movement, the master controller 16 may monitor and may refer to the seat position data 76, the pair of armrests data 78, the plurality of telescoping segments data 80 and/or the user data 82 so to determine a position, an orientation, the status, and/or the like of the pair of armrests 14 and the wheelchair 12, as discussed above. The master controller 16 may then concurrently provide instruction signals to various components of the wheelchair 12 and the pair of armrests 14 including the control unit 60 to move the respective components of the wheelchair 12 and/or the pair of armrests 14 as appropriate.

It should be understood that while some of the components of FIG. 5 are illustrated as residing within the master controller 16 while others reside within the control unit 60, this is merely an example thereof. In some embodiments, one or more of the components may reside solely within the master controller 16, or, in the alternative, one or more components may be external to the control unit 60 and to the master controller 16.

Still referring to FIG. 5, it should also be appreciated that the master controller 16 may receive new and/or updated instructions or configurations as needed. It should also be appreciated that the logic module 62*a*, the memory component 62 and/or the processing device 64 may also receive updates and/or new user initiated programs from time to time. These updates may be based on the user 22 and/or the type of wheelchair 12 and/or or the type of the pair of armrests 14. Moreover, the user 22 or a remote third party, such as a physician, may use an application installed on a smart device, tablet, wearable, or a computer that communicates with the master controller 16 so to select the user initiated program or to provide a manual control of the wheelchair 12 and/or the pair of armrests 14 to facilitate movement, update the master controller 16, and/or further program the master controller 16.

Referring now to FIGS. 1-5, as discussed herein, in some embodiments, the master controller 16 may determine whether the seat portion 20 of the wheelchair 12 is in a raised or standing position, and if so, permit the pair of armrests 14 to pivot from the first position to the second position, permit telescoping of the plurality of telescoping segments 54 to extend, and permit the pair of armrests 14 to be released from the frame 19 of the wheelchair 12 to form the pair of crutches 15. In this embodiment, the master controller 16 may automatically determine whether the position of the seat portion 20, the position of the pair of armrests 14 and their respective components based on an input from the user 22. For instance, the user 22 may have a musculoskeletal injury where the user 22 requires the assistance of the pair of crutches 15 to exit or enter the wheelchair 12. As such, the user 22 may need assistance in movement while in the wheelchair 12 as well as while out of the wheelchair 12. Therefore, the user 22 may request for the pair of armrests 14 to be transitioned into the pair of crutches 15 via the user input. In response, the master controller 16 pivots the pair of armrests 14 from the first to the second position, regardless of the position of the seat portion 20 of the wheelchair 12 relative to a height in the system vertical direction (i.e., in the +/−Z direction), as discussed in greater detail herein. If the seat portion 20 is in the raised position, the master controller 16 permits the plurality of telescoping segments 54 to extend in the system vertical direction (i.e., in the +/−Z direction) when the pair of armrests 14 are in the second position and once the plurality of telescoping segments 54 are extended, the pair of armrests 14, now transformed into the pair of crutches 15, may be released from the frame 19 of the wheelchair 12 based on the user input. On the other hand, if the seat portion 20 of the wheelchair 12 is in a position, other than the raised position when the pair of armrests 14 are in the second position, the master controller 16 blocks the plurality of telescoping segments 54 from being extended while releasably coupled to the frame 19 of the wheelchair 12, but will permit a release of the pair of armrests 14 from the frame 19 of the wheelchair 12 based on a user input. It should be appreciated that the pair of armrests 14, when transformed into the pair of crutches 15, function independently of the wheelchair 12. That is, the pair of armrests 14, when transformed into the pair of crutches 15, independently move from the wheelchair 12 with the user, similar to traditional crutches. In some embodiments, the master controller may raise the seat portion 20 to predetermined heights based on each user via the user input such that the seat is positioned for the user to transform the pair of armrests 14 into the pair of crutches 15.

Figure 6:
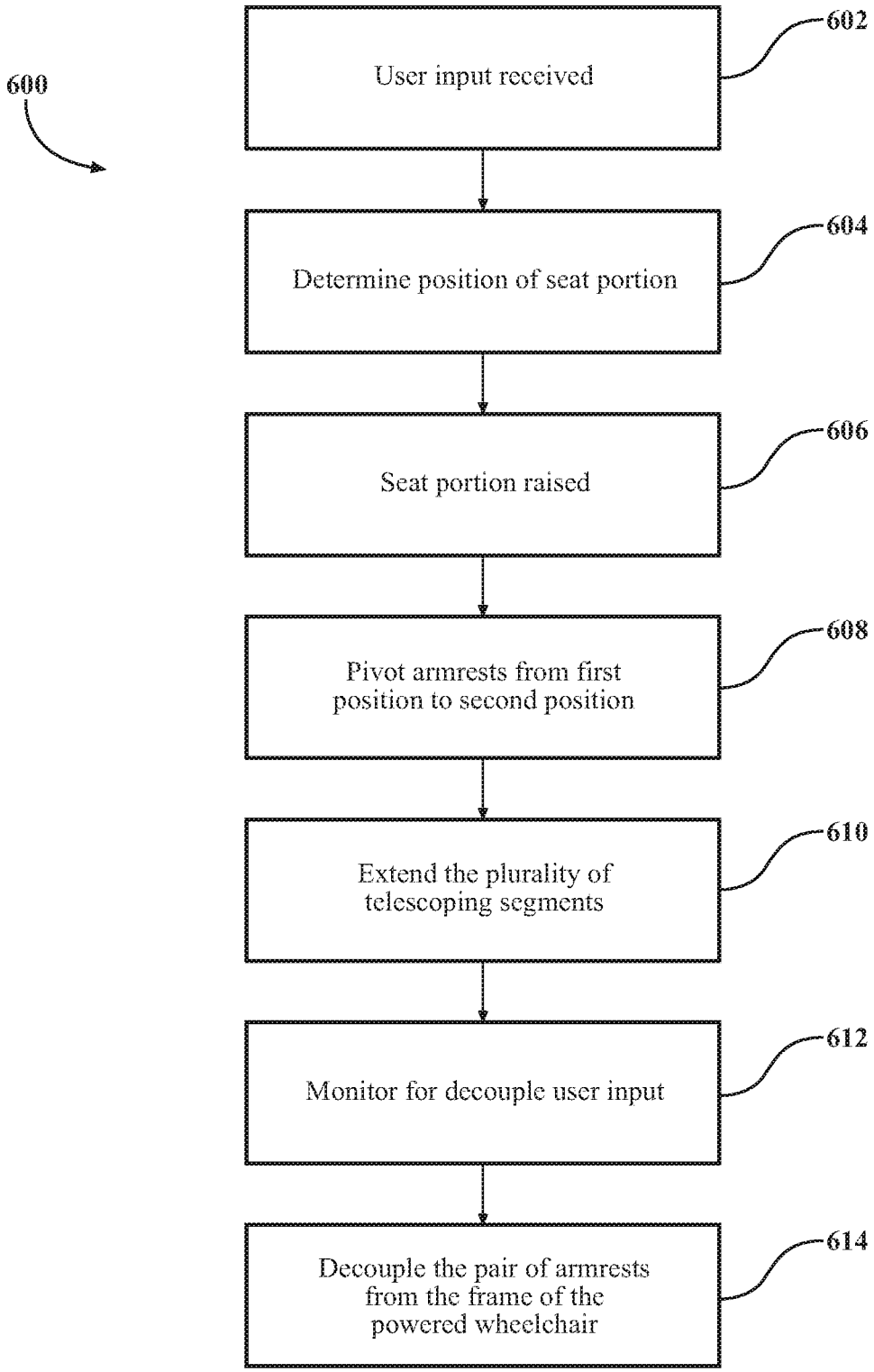
FIG. 6 depicts a flowchart of an illustrative method carried out by a master controller in communication with the powered wheelchair and the pair of armrests of FIG. 1 according to one or more embodiments shown or described herein.

Now referring to FIG. 6, a flowchart of an illustrative method 600 of communication between the master controller 16, the wheelchair 12, and the pair of armrests 14 of FIGS. 2-3 is depicted. In some embodiments, the master controller 16 may be in continuous communication with the wheelchair 12 and the pair of armrests 14 to execute the various steps depicted in FIG. 3. The master controller 16 may monitor for a user input that corresponds to a particular movement of the wheelchair 12 and/or the pair of armrests 14 at step 602. Once the input is received, the master controller 16 may determine a positioning of the seat portion 20 of the wheelchair 12 by obtaining information from the seat position sensor 61 and may store the information as the seat position data 76 at step 604. The master controller 16 may instruct the wheelchair 12 (or components thereof) to raise the seat portion 20 of the wheelchair 12 in the system vertical direction (i.e., in the +/−Z direction) if the seat portion 20 is not in the raised position at step 606. Once the seat portion 20 is confirmed to be in the raised position, the master controller 16 may instruct the pair of armrests 14 (or components thereof) to pivot from the first position to the second position at step 608. It should be appreciated that the second position may be adjustable by preset programming based on a user position, height, and the like. Further, in some embodiments, in the second position, the arm pad 36 is placed under an arm of the user 22, in the general arm pit area.

Once the pair of armrests 14 is confirmed to be in the second position, the master controller 16 may instruct the pair of armrests 14 (or components thereof) to extend the plurality of telescoping segments 54 in the system vertical direction (i.e., in the +/−Z direction) at step 610. It should be appreciated that the number of the plurality of telescoping segments, the length of the plurality of telescoping segments, the angle of the plurality of telescoping segments with respect to the sleeve 40 and the like may vary. The master controller 16 may again monitor for any user input requests to decouple the pair of armrests 14 from the wheelchair 12 at step 612. Once the input is received, the master controller 16 may instruct the pair of armrests 14 (or components thereof) and/or the wheelchair 12 (or components thereof) to decouple the pair of armrests 14 from the frame 19 of the wheelchair 12 at step 614.

It should be appreciated that the illustrative method 600 depicted in FIG. 6 indicates that the process is only in a single direction. However, this is for illustrative purposes merely to explain a single iteration or loop of the program. It should be appreciated that the process may work in reverse order to assist the user 22 in attaching the pair of crutches 15 onto the wheelchair 12 to transform the pair of crutches 15 into the pair of armrests 14.

With reference back to FIG. 1 and still referring to FIG. 6, it should also be appreciated that the pair of armrests 14 may pivot from the first position to the second position at step 606 with the seat portion 20 of the wheelchair 12 in any position (i.e., not necessarily in the raised position). In this embodiments, the master controller 16 may prohibit the pair of armrests 14 (or any component thereof) from extending the plurality of telescoping segments 54 (FIG. 2) in the system vertical direction (i.e., in the +/−Z direction) at step 610, when the seat portion 20 is not in the raised position, as discussed in greater detail with respect to FIG. 7.

Figure 7:
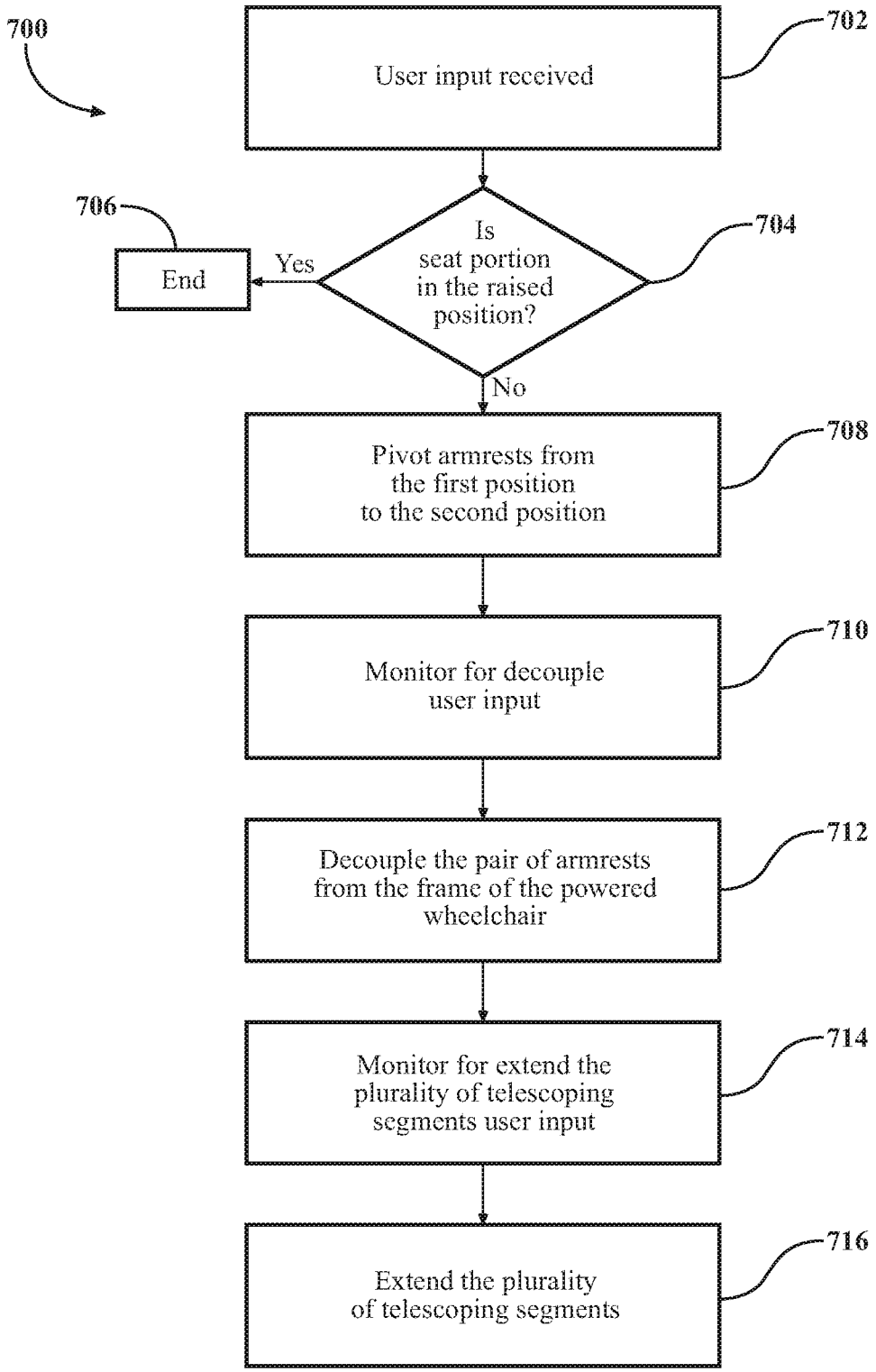
FIG. 7 depicts a flowchart of illustrative method carried out by a master controller and the control unit in communication with the pair of armrests of FIG. 1 according to one or more embodiments shown or described herein.

Now referring to FIG. 7, a flowchart of an illustrative method 700 of communication between the master controller 16, the wheelchair 12, and the pair of armrests 14 of FIG. 1 and the pair of crutches 15 of FIG. 3 are depicted. In some embodiments, the master controller 16 may be in continuous communication with the wheelchair 12 and the pair of armrests 14 to execute the various steps described in the illustrative method 700 when the seat portion 20 of the wheelchair 12 is in any position except the raised position. The master controller 16 may monitor for a user input that corresponds to a particular movement of the wheelchair 12 and/or the pair of armrests 14 at step 702. Once the input is received, the master controller 16 may determine a positioning of the seat portion 20 of the wheelchair 12 by obtaining information from the seat position sensor 61 and may store the information as the seat position data 76 at step 704, to ensure that the seat portion 20 is in any position except in the raised position. If the seat portion 20 is in the raised position, the illustrative method 700 ends at step 706. It should be appreciated that the master controller 16 may utilize the method 600 in FIG. 6 once it is determined that the seat portion 20 is in the raised position and the method 700 is ended. Once the seat portion 20 is confirmed to be in any other position but the raised position, the master controller 16 may instruct the pair of armrests 14 (or components thereof) to pivot from the first position to the second position at step 708. It should be appreciated that the second position may be adjustable by preset programming based on a user position, height, and the like. Further, in some embodiments, in the second position, the arm pad 36 is placed under an arm of the user 22, in the general arm pit area.

Figure 4:
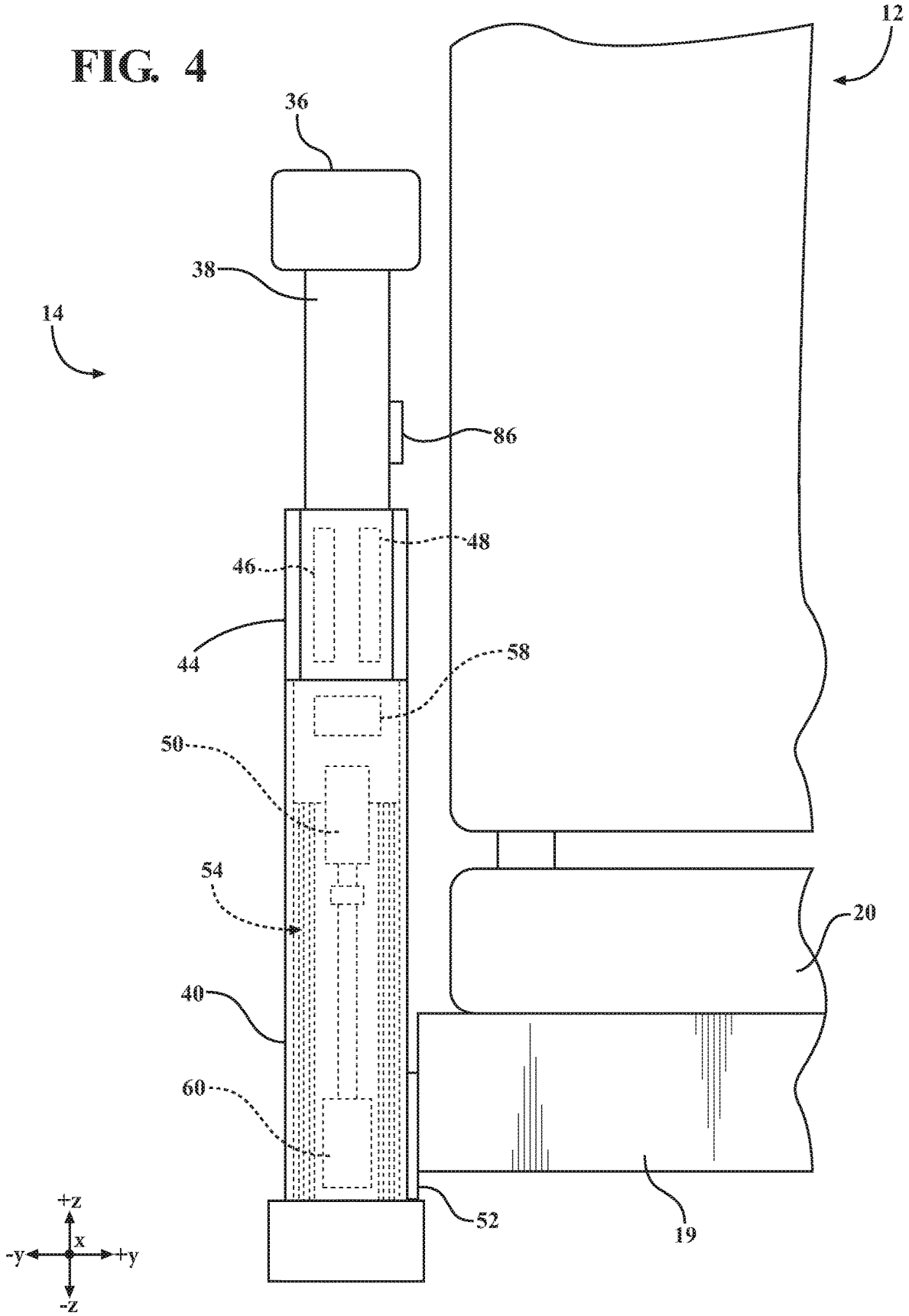
FIG. 4 schematically depicts a partial rear view of the system of FIG. 1 according to one or more embodiments shown or described herein.

Once the pair of armrests 14 is confirmed to be in the second position, the master controller 16 may again monitor for any user input requests to decouple the pair of armrests 14 from the wheelchair 12 at step 710. Once the input is received, the master controller 16 may instruct the pair of armrests 14 (or components thereof) and/or the wheelchair 12 (or components thereof) to decouple the pair of armrests 14 from the frame 19 of the wheelchair 12 at step 712. Once decoupled, the control unit 60 monitors for any user input requests to extend the plurality of telescoping segments 54 in the system vertical direction (i.e., in the +/−Z direction) at step 714. Once the input is received, the control unit 60 may instruct the at least one actuator 50 of the pair of armrests 14 (or other components thereof) to extend the plurality of telescoping segments 54, at step 716, to transform the pair of armrests 14 into the pair of crutches 15 (FIG. 4).

It should be appreciated that the process depicted in FIG. 7 indicates that the process is only in a single direction. However, this is for illustrative purposes merely to explain a single iteration or loop of the program. It should be appreciated that the process may work in reverse order to assist the user 22 in retracting the plurality of telescoping segments 54 and attaching the now pair of crutches 15 onto the wheelchair 12 to transform the pair of crutches 15 into the pair of armrests 14.

Further, with respect to FIGS. 6-7, the methods described therein are for electrical, electro-mechanical, and the like, functionality of the wheelchair 12. These are non-limiting examples. As discussed herein, the pair of armrests 14 (FIG. 1) may be transformed into the pair of crutches 15 (FIG. 3) by the user 22 and vice versa using mechanical means as described herein.

It should now be understood that the systems and methods described herein includes the powered wheelchair, the pair of armrests, and the master controller. The master controller monitors the independent movements of the powered wheelchair and the pair of armrests such that the powered wheelchair and the pair of armrests operate in a coordinated fashion and/or independent from one another such that the pair of armrests may be transformed into a pair of crutches.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A wheelchair comprising:
a frame;
an armrest comprising:
a first end and a second end spaced apart from the first end;
a sleeve configured to store a plurality of telescoping segments, the plurality of telescoping segments configured to extend in a system vertical direction; and
a pivot portion positioned between the first end and the second end,
wherein:
the armrest is releasably coupled to the frame at the sleeve via a release mechanism,
the armrest is pivotable between a first position and a second position,
when in the first position, the armrest is in an armrest position, and
in the second position, the armrest is pivoted in the system vertical direction such that the armrest is configured as a crutch independently operable from the wheelchair.

2. The wheelchair of claim 1, wherein the release mechanism to release the sleeve of the armrest from the frame is a locking pin.

3. The wheelchair of claim 1, wherein the release mechanism to release the sleeve of the armrest from the frame is a magnetic component or an electro-magnetic component.

4. The wheelchair of claim 1, wherein:
the armrest is a pair of armrests;
the pair of armrests is pivotable between the first position and the second position;
when in the first position, the pair of armrests is in the armrest position; and
in the second position, the pair of armrests is pivoted in the system vertical direction such that the pair of armrests is configured as a pair of crutches independently operable from the wheelchair.

5. The wheelchair of claim 1, wherein the plurality of telescoping segments are released from the sleeve when the armrest is in the second position.

6. The wheelchair of claim 1, wherein
the pivot portion includes a clutch, and
the clutch is controlled by a lever that releases the clutch such that the armrest pivots between the first position and the second position.

7. A powered wheelchair comprising:
a frame;
a pair of armrests releasably coupled to the frame via a release mechanism, the pair of armrests comprising:
a first end and a second end;
a sleeve configured to store a plurality of telescoping segments, the plurality of telescoping segments configured to extend in a system vertical direction; and
a pivot portion positioned between the first end and the second end;
a master controller,
wherein:
the pair of armrests is communicatively coupled to the master controller,
the master controller coordinates pivoting the pair of armrests between a first position and a second position,
when in the first position, the pair of armrests is in an armrest position, and
in the second position, the pair of armrests is pivoted in the system vertical direction such that the pair of armrests is configured as a pair of crutches independently operable from the powered wheelchair.

8. The powered wheelchair of claim 7, wherein:
the powered wheelchair further includes a seat portion coupled to the frame, and
the master controller coordinates a plurality of synchronized movements, the plurality of synchronized movements includes causing the seat portion to raise in the system vertical direction and pivoting the pair of armrests to the second position.

9. The powered wheelchair of claim 8, wherein the seat portion is configured to raise in the system vertical direction to a standing position.

10. The powered wheelchair of claim 9, wherein the plurality of synchronized movements includes causing the plurality of telescoping segments to be extended in the system vertical direction when the pair of armrests are in the second position and the seat portion is in the standing position.

11. The powered wheelchair of claim 7, wherein the pivot portion includes a clutch, and the clutch is controlled by the master controller that releases the clutch such that the pair of armrests pivots between the first position and the second position.

12. The powered wheelchair of claim 8, wherein the master controller receives an input from a user and the master controller coordinates the plurality of synchronized movements based on the input.

13. The powered wheelchair of claim 12, wherein the input is provided via one or more of a voiced command, a button push, a switch toggle, and a user interface selection.

14. The powered wheelchair of claim 8, wherein:

the pair of armrests further include an actuator and a battery, the master controller coordinates a plurality of synchronized movements, the plurality of synchronized movements includes causing the seat portion to lower in the system vertical direction to a sitting position, and when the pair of armrests are decoupled from the frame when the seat portion is in the sitting position, the actuator causes the plurality of telescoping segments to be extended in the system vertical direction.

15. The powered wheelchair of claim 14, wherein the actuator receives an input from a user and the actuator causes the plurality of telescoping segments to be extended or retracted in the system vertical direction based on the input.

16. The powered wheelchair of claim 14, wherein the actuator and the battery are communicatively coupled to the master controller when the pair of armrests are coupled to the frame such that the master controller or the actuator causes the plurality of synchronized movements.

17. The powered wheelchair of claim 7, wherein the release mechanism to release the pair of armrests from the frame is one of an electro-magnetic component, a magnetic component, and a locking pin.

18. A method of controlling a pair of armrests of a powered wheelchair to use the pair of armrests as a crutch, the method comprising: receiving, by a master controller, an input from a user, the input corresponding to a function; raising, by the master controller, a seat portion of the powered wheelchair in a system vertical direction; pivoting, by the master controller, the pair of armrests from a first position to a second position; extending, by the master controller, a plurality of telescoping segments in the system vertical direction; and decoupling, by the master controller, the pair of armrests from a frame of the powered wheelchair.

19. The method of claim 18, wherein the first position is an armrest position and the second position is a crutch position such that the pair of armrests are transformed into a pair of crutches independently operable from the powered wheelchair.

20. The method of claim 19, wherein the plurality of telescoping segments are adjustable to a predetermined height of the user based on a predetermined height of the powered wheelchair in the system vertical direction.

* * * * *